United States Patent [19]

Thompson et al.

[11] 4,379,426

[45] Apr. 12, 1983

[54] TRUSS-FABRICATING MACHINE

[75] Inventors: James L. Thompson, Ballwin; Owen T. Hornkohl, Webster Groves, both of Mo.

[73] Assignee: Moehlenpah Industries, Inc., St. Louis, Mo.

[21] Appl. No.: 303,398

[22] Filed: Sep. 18, 1981

[51] Int. Cl.[3] ..... B30B 15/00

[52] U.S. Cl. ..... 100/100; 100/913; 227/152; 269/910

[58] Field of Search ..... 100/100, 295, 913, 269 A, 100/257, 291, 264; 227/152; 269/910; 29/798

[56] References Cited

U.S. PATENT DOCUMENTS

| | | | |
|---|---|---|---|
| 1,312,615 | 8/1919 | Cooper | 100/269 A |
| 2,560,902 | 7/1951 | Smith | 100/269 A |
| 3,868,898 | 3/1975 | Sanford | 100/913 X |
| 3,978,783 | 9/1976 | Moehlenpah | 100/913 X |
| 4,002,116 | 1/1977 | Knowles | 100/100 |
| 4,024,809 | 5/1977 | Moehlenpah | 100/913 X |
| 4,044,093 | 8/1977 | Jureit | 269/910 X |
| 4,184,621 | 1/1980 | Epes | 100/913 X |

*Primary Examiner*—Billy J. Wilhite

*Attorney, Agent, or Firm*—Senniger, Powers, Leavitt and Roedel

[57] ABSTRACT

A truss-fabricating machine comprising a table for supporting a pair of parallel spaced-apart wood chord members, a series of web members spanning the chord members, and connectors having teeth adapted to be pressed into the wood chord members. The machine further comprises apparatus on the top of the table for clamping the chord members in fixed position with respect to the table, including a pair of outside jaws engageable with the outside faces of the chord members, and expansible tubing extending longitudinally of the table for effecting movement of the outside jaws relative to one another transversely of the table to clamp the chord members in fixed position with respect to the table. A press is movable longitudinally with respect to the table for pressing the teeth of the connectors into the chord members when the chord members are clamped in fixed position.

47 Claims, 19 Drawing Figures

TRUSS-FABRICATING MACHINE

BACKGROUND OF THE INVENTION

This invention relates generally to apparatus useful in the fabrication of building trusses, particularly flat trusses of the type comprising a pair of parallel wood chord members (e.g., 2×4's), a series of web members spanning the chord members, and connector means having teeth adapted to be pressed into the chord members for rigidly interconnecting the web and chord members.

The present invention is especially suited for (but not limited to) fabricating parallel-chord flat trusses wherein the chord members are of wood and the web members are of metal and have teeth struck therefrom, as shown and described in coassigned pending U.S. patent application Ser. No. 63,791 now U.S. Pat. No. 4,348,850. The substitution of such combination wood-metal trusses for solid lumber floor and ceiling joists has become wide-spread for several reasons, one being the relatively high cost of wood joists. Moreover, a combination wood-metal truss is lighter, stronger and enables duct work, piping and wiring to be routed through the open spaces between the chord members.

Heretofore, there have been several machines capable of fabricating wood-metal trusses, including the machine shown in U.S. Pat. No. 4,002,116 and the machine described in coassigned pending U.S. application Ser. No. 202,866.

SUMMARY OF THE INVENTION

Among the several objects of this invention may be noted the provision of an improved machine for fabricating parallel chord flat trusses, particularly combination wood-metal flat trusses; the provision of such a machine which is readily adjustable to fabricate trusses of various depths, lengths and configurations, the provision of such a machine which is adapted for quick and easy loading of the wood chord members into the machine and for removal of a finished truss therefrom; the provision of such a machine which securely holds the web and chord members in proper position relative to one another prior to and during the pressing operation; the provision of such a machine which is rugged in construction for increased durability, and which is reliable in operation; and the provision of such a machine which is economical to manufacture.

Generally, a machine of the present invention is useful for fabricating trusses of the type comprising a pair of generally parallel wood chord members having opposing inside faces spaced apart a predetermined distance, and outside faces, a series of web members (e.g., metal web members) spanning the wood chord members, and connector means having teeth adapted to be pressed into the wood chord members for rigidly interconnecting the web and chord members. The machine comprises a table having an elongate top for supporting the chord members, web members and connector means in a position in which the web members are generally horizontal, in which the teeth of the connector means are generally vertical, and in which the wood chord members extend longitudinally of the table, and means on the top of the table for clamping the chord members in fixed position with respect to the table. This means comprises outside jaw means engageable with the outside faces of the chord members of said pair of chord members. The outside jaw means comprises expansible tube means extending longitudinally of the table for effecting clamping action of the outside jaw means against the chord members to clamp them in fixed position with respect to the table. The tube means has inlet means for entry of a pressurized fluid into the tube means thereby to expand the tube means in cross section, the tube means during such expansion being adapted to effect said clamping action. A press is movable longitudinally with respect to the table top for pressing the teeth of the connector means into the chord members when the chord members are clamped in fixed position with respect to the table.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
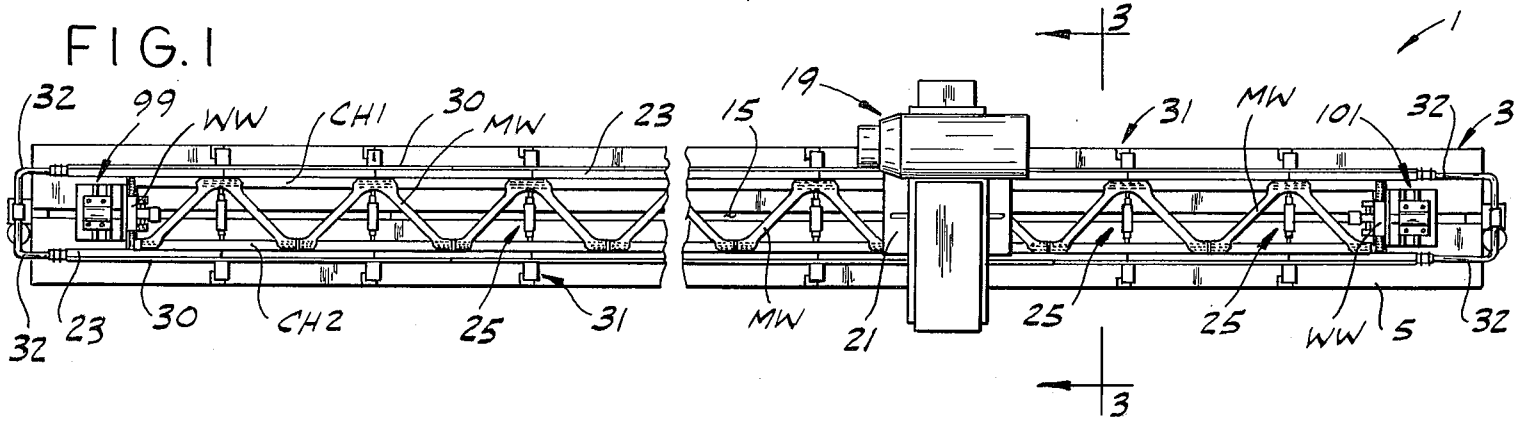
FIG. 1 is a plan of a truss-fabricating machine of the present invention, portions of the machine being broken away for purposes of illustration.
Figure 2:
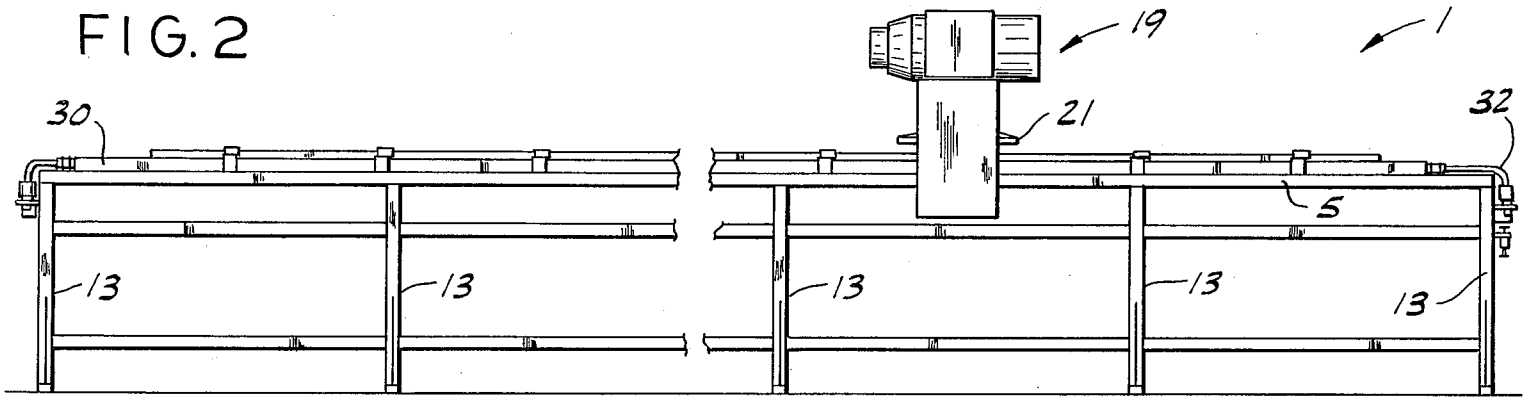
FIG. 2 is a side elevation of FIG. 1.
Figure 3:
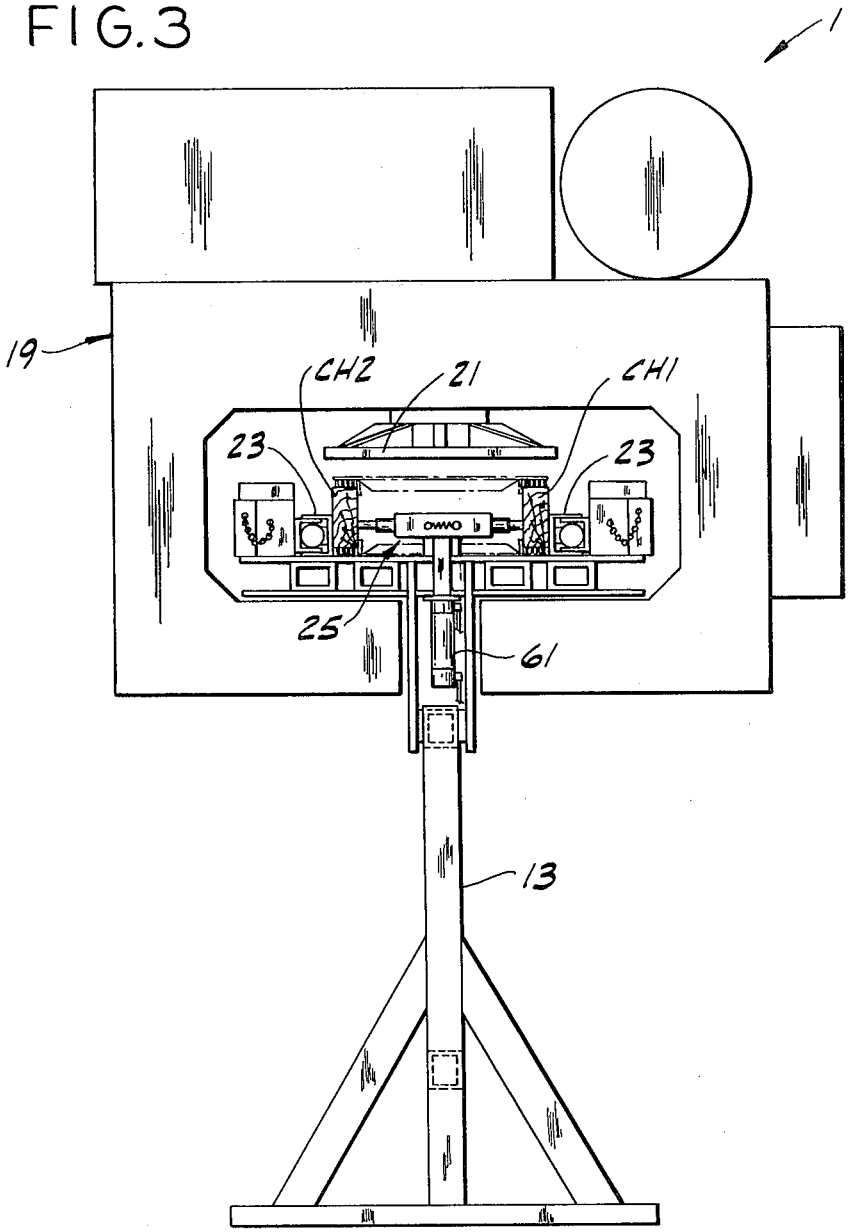
FIG. 3 is an enlarged vertical section on line 3—3 of FIG. 1.

Referring now to the drawings, first more particularly to FIGS. 1–3, there is generally indicated at 1 a machine for fabricating parallel chord flat trusses. The machine is especially suited for the fabrication of combination wood-metal floor (and ceiling or roof) trusses of the type comprising a pair of generally parallel spaced-apart wood chord members CH1, CH2 (e.g., 2×4's) and a series of relatively flat V-shaped metal web members MW spanning the chord member at spaced intervals along the chord members on opposite sides thereof. These web members, which are of the type described in detail in coassigned pending U.S. patent application Ser. No. 63,791, have integral connector or nailing plate portions with teeth T struck therefrom which are pressed into the chord members, the nailing plate portions thus constituting means for rigidly interconnecting the web and chord members to form a truss.

The machine 1 comprises a relatively long table, generally designated 3, having a double-decked top 5 formed by a series of parallel horizontally disposed box beams 7 extending longitudinally of the table, a series of flat metal plates spanning the tops of the beams and constituting an upper deck 9, and a series of flat metal plates affixed (e.g., welded) to the bottom faces of the beams and constituting a lower deck 11. Legs 13 are spaced at intervals longitudinally of the table, which is of sufficient length to accommodate one long truss or two or more shorter trusses. For example, the table may be 44 ft. long to accommodate one 40 ft. long truss or two trusses of up to 20 ft. in length. For purposes of illustration the machine is shown in the drawings as fabricating one long truss. The upper and lower decks 9, 11 of the table top have aligned central longitudinal slots therein extending the length of the table, the slot in the upper deck being designated 15 and the slot in the lower deck 17. The slots are curved on arcs corresponding to the camber which is to be imparted to a finished truss or trusses.

In accordance with this invention, the machine is equipped both for holding a lower set of metal web members MW for each truss to be fabricated in a position in which the web members are spaced at intervals along the top of the table in generally horizontal position with their teeth T pointing up, and for clamping the two wood chord members CH1, CH2 of each truss in a position in which they overlie the web members MW with their lower faces in contact with the teeth T. An upper set of metal web members MW is adapted to be manually placed atop the chord members of each truss generally opposite the lower set of web members, with the teeth of the upper web members pointing downwardly and contacting the upper faces of the two chord members. A press, generally designated 19, is movable longitudinally with respect to the table and carries a vertically movable platen 21 for driving the teeth of the web members MW into the upper and lower faces of the chord members to form a truss or trusses on the table.

More specifically, the machine is equipped with outside jaw means comprising first and second outside jaws, each designated 23, engageable with the outside faces of the first and second chord members CH1, CH2, respectively. Each jaw 23 is an elongate member extending longitudinally of the table for engagement with a respective chord member along substantially the entire length of the chord member. A plurality of jaw assemblies, each generally designated 25, are spaced at intervals (e.g., every 2 feet) longitudinally of the table between the outside jaws. Each assembly comprises a pair of inside jaws, the first jaw **27*a* of the pair being engageable with the inside face of the first chord member CH1 and the second jaw 27*b*** of the pair being engageable with the inside face of the second chord member CH2.

Figure 4:
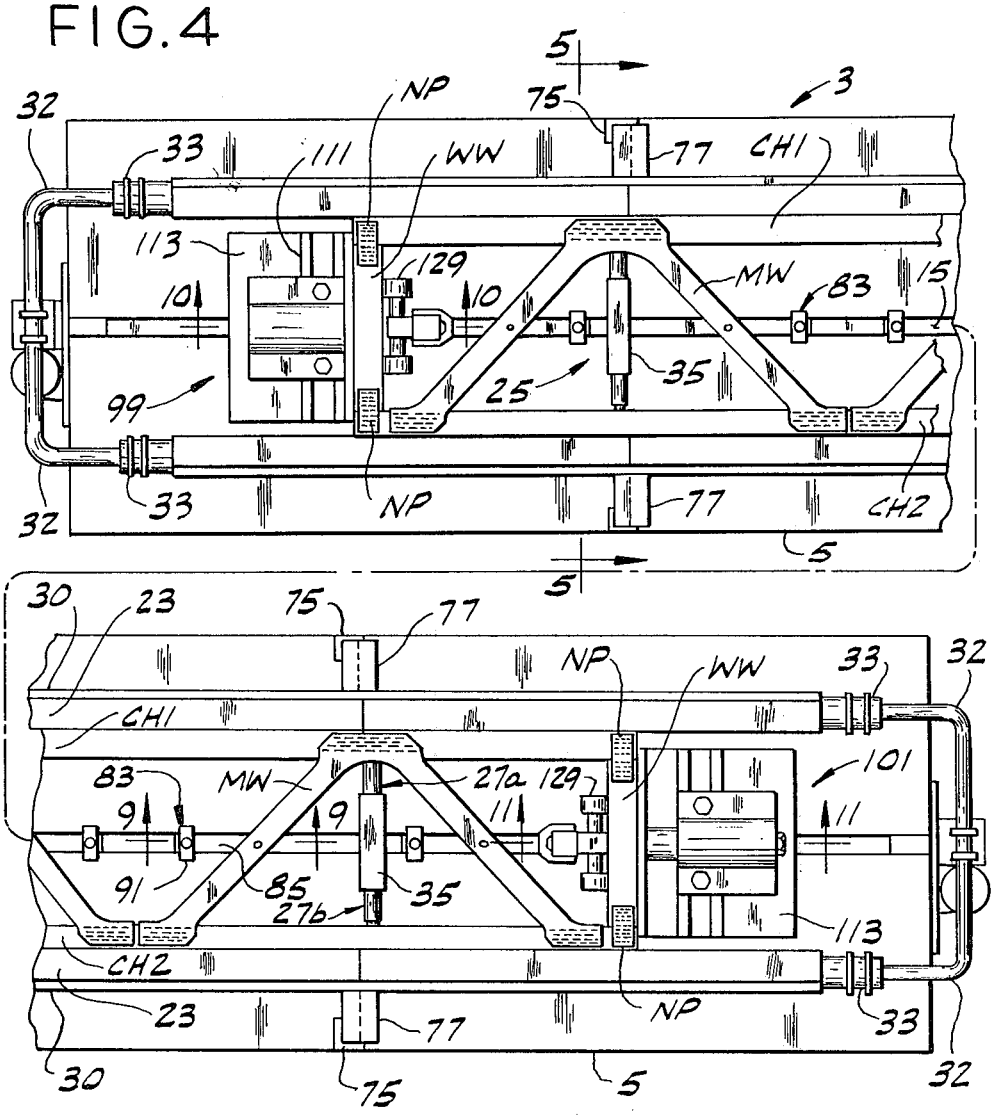
FIG. 4 is an enlarged plan of the ends of the machine shown in FIG. 1.

The outside jaws 23 are relatively movable transversely of the table for clamping the chord members CH1, CH2 against the inside jaws **27*a*, *b*. This relative movement is effected by expansible tube means, in this case tubing comprising two sets of hoses, each hose being designated 29, extending longitudinally of the table closely adjacent the outside jaws 23 on the outside of the jaws. Each set includes two parallel hoses extending approximately one-half the length of the table, with the two hoses of one set having inlet ends adjacent the left end of the table (as viewed in FIGS. 1 and 4) and the two hoses of the other set having inlet ends adjacent the right end of the table. Two elongate backing members 30 extend longitudinally of the table generally parallel to the outside jaws 23 on the outside of the tubes 29. These backing members 30 are held in fixed position with respect to the table against outward movement away from the hoses 29 by means generally indicated at 31**.

Pressurized fluid (e.g., 60 psi air) is introduced into the hoses via lines 32 connected to the inlet ends of the hoses by conventional fittings 33. The opposite ends of the hoses at the center of the table are sealed shut by plugs (not shown). When pressure air is introduced into the hoses, they are adapted to expand in cross section and to react against the fixed backing members 30 for pushing the outside jaws 23 inwardly a relatively short distance (e.g., ¼ in.) to effect a clamping action on the chord members by clamping them against the inside jaws **27*a*, *b* in a position in which the lower horizontal faces of the chord members overlie the teeth T of the metal web members MW therebelow. The hoses 29** are of a material that will satisfactorily sustain repetitive expansion and relaxation by cyclic pneumatic pressurization and release or venting. Among suitable hose materials are lengths of heavy-duty mining hose or fire hose of laminated vinyl synthetic resins such as sold by Semcor of St. Louis, Missouri. It will be understood that when it is stated that the hoses "expand" in cross section, this does not necessarily mean that the hose material stretches; it simply means that the cross-sectional dimension of each hose increases (either with or without stretch).

Figure 5:
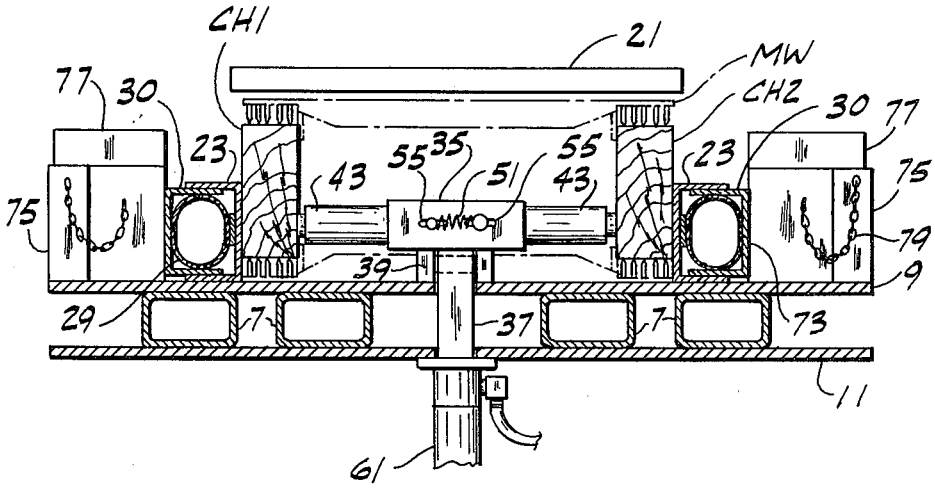
FIG. 5 is an enlarged vertical section on line 5—5 of FIG. 4.

Each inside jaw assembly 25 between the outside jaws 23 comprises a guide 35 of square-section tubular bar stock mounted atop a post 37 extending vertically up through the slots 15, 17 in the upper and lower decks 9, 11 of the table top. The two inside jaws **27*a*, *b* of each jaw assembly are slidable in the guide 35 relative to one another along a horizontal axis extending in transverse direction with respect to the table top between extended positions (FIG. 5) in which the jaws are engageable with the inside vertical faces of the wood chord members CH1, CH2 for spacing them apart a predetermined distance, and retracted positions (FIG. 6) in which the jaws are closer together. A U-shaped support member 39 around the guide post 37 between the guide 35 and the top of the table supports the guide at an elevation at which the jaws 27*a*, *b*, when extended, engage the opposing relatively wide vertical faces of the chord members. It will be observed that since the jaw assemblies 25 are mounted in camber slots 15, 17, the inside jaws 27*a* are in a position for imparting a camber to the first chord member CH1 when a respective outside jaw 23 clamps the chord member against the jaws 27*a*, and that the inside jaws 27*b* are in a position for imparting a camber to the second chord member CH2 when the other outside jaw 23 clamps the chord member against jaws 27*b***.

Figure 7:
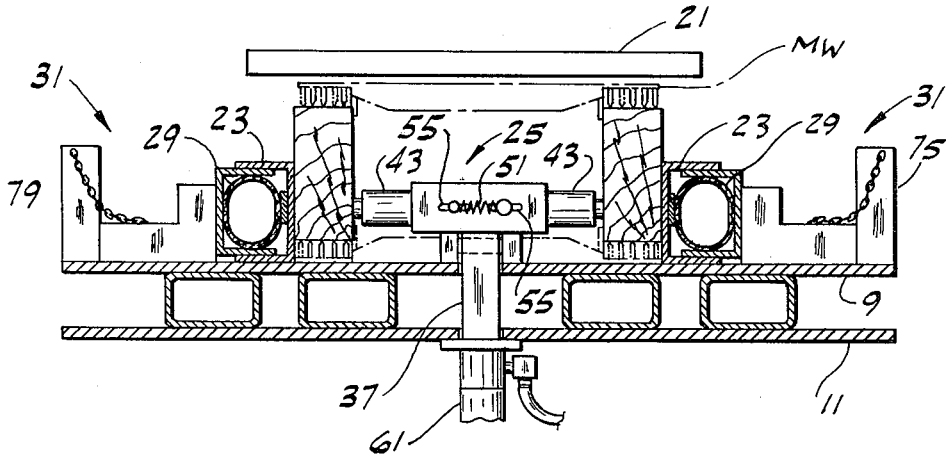
FIG. 7 is a view similar to FIG. 5 showing the machine adjusted for fabricating a truss of different depth.

Each of the two inside jaws **27*a*, *b* of each jaw assembly 25 has a rectangular section body portion 41 slidable in the guide 35 and a cylindric head portion 43 extending outwardly from one end of the body portion for engagement with the inside face of a respective chord member CH1, CH2. The head portion 43 is detachably mounted on the body portion 41 by means of a mounting pin 45 extending from the head portion into a recess constituted by a blind bore 47 in the body portion of the jaw. By slipping the mounting pin out of the bore 47, the head portion 43 may readily be detached from the body portion of the jaw and a head portion of different size (i.e., length) substituted therefor for varying the distance between the inside faces of the chord members to fabricate trusses of different depths (compare FIGS. 5 and 7). The ends of a cylindric insert 49 extending diametrically through each mounting pin 45 at its inner end frictionally engage the walls of the bore 47** to restrain the pin against slippage out of the bore.

Figure 6:
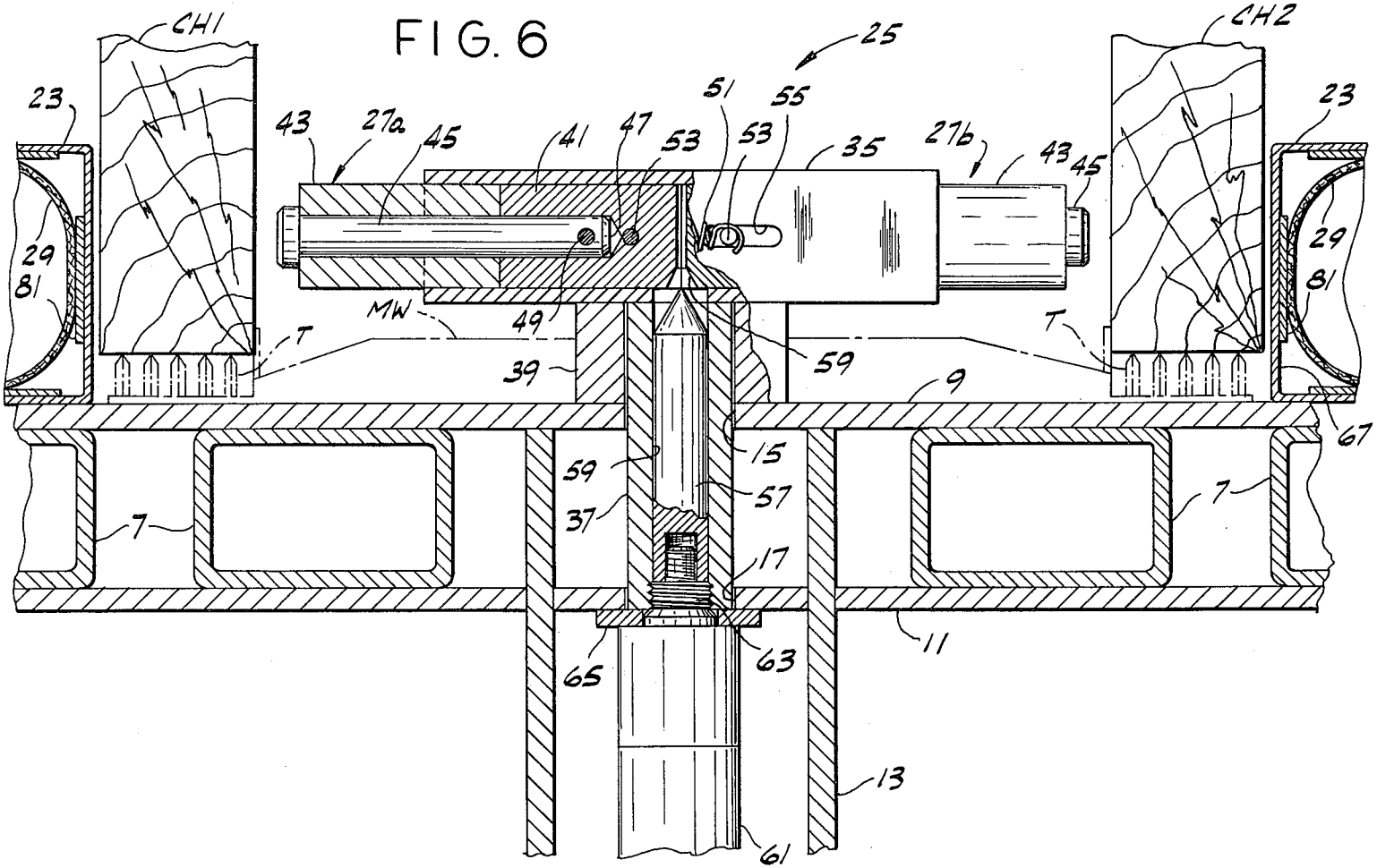
FIG. 6 is an enlarged portion of FIG. 5 with portions broken away to illustrate details.

The inside jaws 27*a, b* of each assembly are biased toward their retracted positions by a pair of tension springs 51 attached to the outer ends of crosspins 53 extending diametrically through the body portions 41 of the jaws 27*a, b* and out through slots 55 in the tubular guide 35 on opposite sides of the guide, the slots being sufficiently long to accommodate movement of the crosspins as the jaws move between their extended and retracted positions. When the inside jaws are in their stated retracted position, the opposing inner ends of the body portions of the jaws 27*a, b* are relatively closely spaced, as illustrated in FIG. 6, the spacing being determined by the engagement of the crosspins 53 with the ends of their respective slots 55.

Cam means comprising a vertically disposed camming bar 57 movable up and down within an axial bore 59 in the guide post 37 functions to expand the inside jaws 27*a, b* of each jaw assembly 25 from their normally retracted position to their extended position. The camming bar 57 is generally cylindric in shape with a pointed (conical) upper end or tip and is movable along its axis from a lowered position (FIG. 6) in which the upper end of the bar is spaced below the jaws 27*a, b*, to a raised position in which the tip of the bar moves up through an opening in the guide 35 between opposing inner ends of the jaw body portions 41 to spread the jaws apart to their extended position. The body portions of the inside jaws are chamfered as indicated at 59 to facilitate entry of the camming bar between the jaws. The camming bar 57 is movable between its raised and lowered positions by power means comprising a double-acting pneumatic cylinder 61 threadably attached by means of a fitting 63 to the lower end of the guide post 37 and having its piston threaded up into the camming bar. A washer 65 around the fitting 63 at the upper end of the cylinder is engageable with the underside of the lower deck 11 of the table top on opposite sides of the slot 17 to prevent upward movement of the jaw assembly 25 relative to the table.

Each outside jaw 23 is channel-shaped, having a vertical web 67 and upper and lower flanges extending generally horizontally outwardly from the web. Each backing member 30 is also channel-shaped, having a web 73 spaced outwardly from the web 67 of the outside jaw and inwardly-extending upper and lower flanges. As shown best in FIG. 5, the flanges of each backing member 30 are received between the flanges of a respective outside jaw 23 and have a sliding interfit therewith.

The pneumatic hoses 29 are disposed between the webs 67 of the outside jaws and the webs 73 of the respective backing members 30, the arrangement being such that when the hoses are pneumatically inflated they react against the stationary webs 73 of the backing members to push the outside jaws 23 inwardly a relatively short distance to clamp the chord members against the inside jaws 27*a, b*. In this regard, each hose 29 should be so dimensioned in cross section relative to the spacing between the webs of a respective outside jaw 23 and backing member 30 that when the hose is inflated and the outside jaw is in its FIG. 5 position clamping a respective chord member, the contact between the hose and each web, as viewed in cross section, is a line contact, rather than a point contact, that is, the hose is flattened against the web over a relatively large area. This reduces the magnitude of the air pressure required to provide the necessary clamping force against the chord member.

The fact that the hoses 29 are entirely enclosed by the channel-shaped jaws 23 and backing members 30 is advantageous in that the hoses are shielded against possible puncture, for example. However, it will be understood that jaws 23 could be eliminated. In this case the hoses 29 would constitute outside jaw means for applying a clamping force directly against the outside faces of the chord members.

Figure 8A:
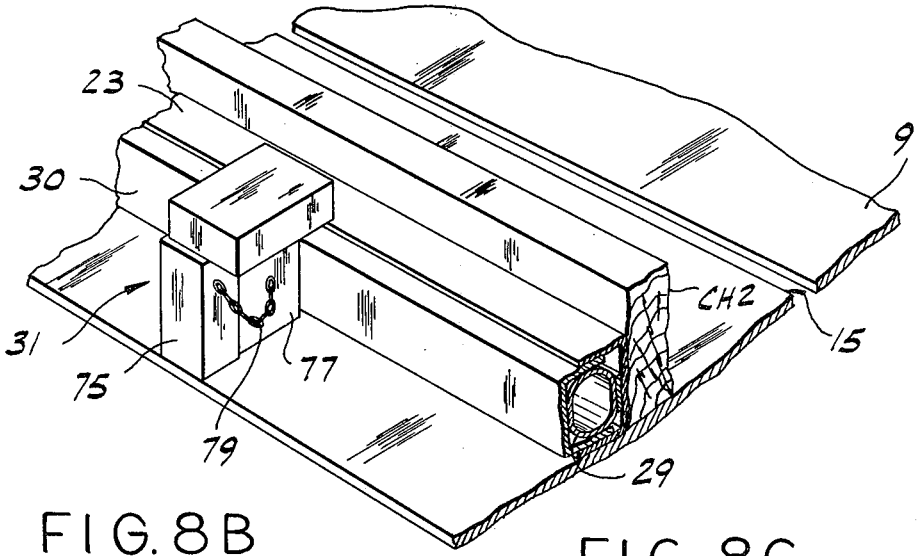
FIGS. 8A–8D are views illustrating means whereby outside jaws of the machine may be adjusted to fabricate trusses of different depth.
Figure 8B:
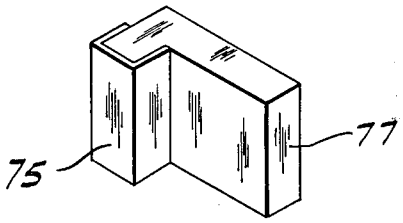
Figure 8C:
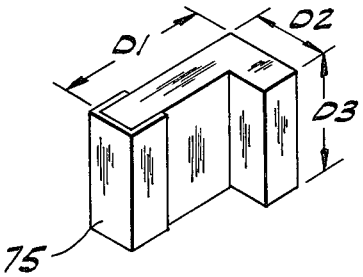
Figure 8D:
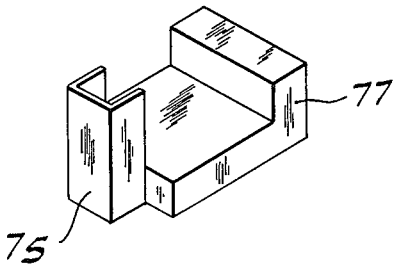

Means 31 for holding the backing members 30 stationary comprises a plurality of stop members 75 mounted at spaced intervals along the table top at both sides of the table, and a plurality of spacers 77, which space the backing members 30 inwardly from the stop members 75, the latter being constituted by inwardly-opening vertical channels. The spacers 77 are identical in size and configuration, each being in the form of an L-shaped block having a plurality of different dimensions D1–D3. As shown best in FIGS. 8A–8D, the block may be placed between respective stop members 75 and backing members 30 in a plurality of different orientations (e.g., four orientations illustrated) to vary the distance at which they space the backing members inwardly from the stop members. Thus by placing the spacer blocks 77 at each side of the table in the same appropriate orientation, the spacing between the backing members 30 (and thus the outside jaws 23) may be adjusted according to the depth of the truss (or trusses) to be fabricated. For example, where the truss to be fabricated is a relatively shallow one, and the head portions 43 of the inside jaws 27*a, b* are consequently relatively short for spacing the chord members relatively close together, the spacer blocks should be oriented (as in FIG. 8C) to space the backing members and associated outside jaws relatively close together; where the truss to be fabricated is a relatively deep one and the jaw head portions 43 are consequently relatively long for spacing the chord members farther apart, the spacer blocks should be oriented (as in FIG. 8B) to space the backing members and associated outside jaws farther apart. Thus the stop members 75 and spacer blocks 77 constitute means for mounting each backing member 30 and its associated outside jaw 23 at different positions of transverse adjustment with respect to the top of the table for varying the spacing between the outside jaws 23 in accordance with the depth of the truss to be fabricated. A small link chain 79 attaches each spacer block to its respective stop member.

The stop members 75 at opposite sides of the table are positioned along lines parallel to the central camber slot 15 in the upper deck 9 of the table top, the arrangement being such that the spacers 77 are adapted to position the backing members 30 on the table at a camber corresponding to the camber to be built into a finished truss. To permit ready cambering of the backing members, each is divided into a plurality of separate longitudinal sections (e.g., 5 ft. sections).

Each outside jaw 23 also comprises a plurality of longitudinal channel-shaped sections (e.g., 2 ft. sections). The sections are preferably connected in groups of predetermined number by resilient metal straps 81 (constituting strap means) which function to hold the sections in general longitudinal alignment (see FIG. 6). The sections may be connected in groups of three, for example, with the three sections of each group being joined by a single strap 81 welded or otherwise suitably secured to the webs 67 of the sections. The straps permit the sections within the individual groups to resiliently flex relative to one another, thereby enabling the outside jaws 23 readily to conform with the camber to be imparted to the chord members. The fact that the outside jaws 23 and backing members 30 are sectioned also enables two trusses of different depth to be fabricated on the table at the same time.

Figure 9:
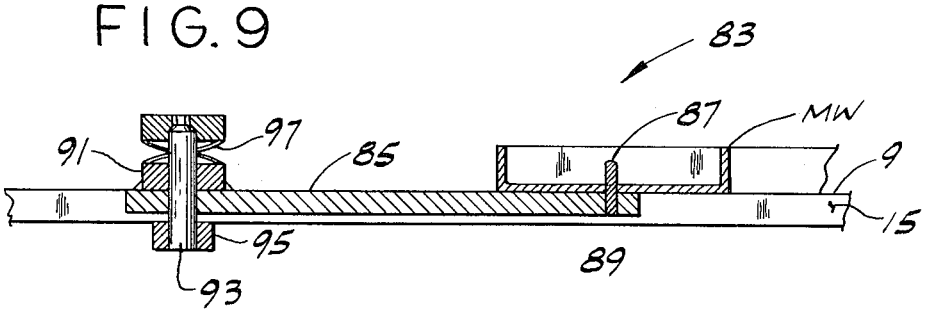
FIG. 9 is an enlarged vertical section on line 9—9 of FIG. 4.

A plurality of locator pin assemblies, each designated 83, mount the lower set (or sets) of metal web members MW in fixed position on the table top between the outside jaws. Each assembly 83 comprises a horizontally disposed elongate metal plate 85 extending longitudinally of the table in the central slot 15 in the upper deck of the table, a locator pin 87 projecting up from one end (the right end as viewed in FIG. 9) of the plate receivable in an opening 89 in a leg of the web member, and a crosspiece 91 at the other end of the plate spanning the slot 15 and bearing on the top of the table at opposite sides of the slot. The assembly also includes latch means comprising a stud 93 extending down through bores in the crosspiece 91 and plate 85, and a latch member 95 rigidly affixed to the bottom of the shank of the stud. The stud is rotatable for pivoting the latch member on the vertical axis of the stud between a latching position (FIGS. 4 and 9) in which it spans the slot 15 below the upper deck of the table for latching the entire assembly in place, and a release position in which it is aligned with the slot for permitting the entire assembly to be removed from the slot. A spring washer 97 around the shank of the stud between the top of the crosspiece 91 and the head of the stud biases the latch member upwardly into engagement with the underside of the upper deck 9 of the table when the latch member is in its latching position, thus ensuring that the assembly is stably held in position. It will be noted, however, that the assembly 83 is slidable longitudinally of the table in the slot 15 when the latch member 93 is in its latching position. This provides for ready adjustment of the spacing between the locator pins 87 of adjacent assemblies, which spacing will depend both on the size of the metal web members MW and the desired spacing therebetween. As illustrated in the drawings, there are two locator pin assemblies 83 per web member MW inasmuch as both legs of the web member have openings 89 therein.

Figure 10:
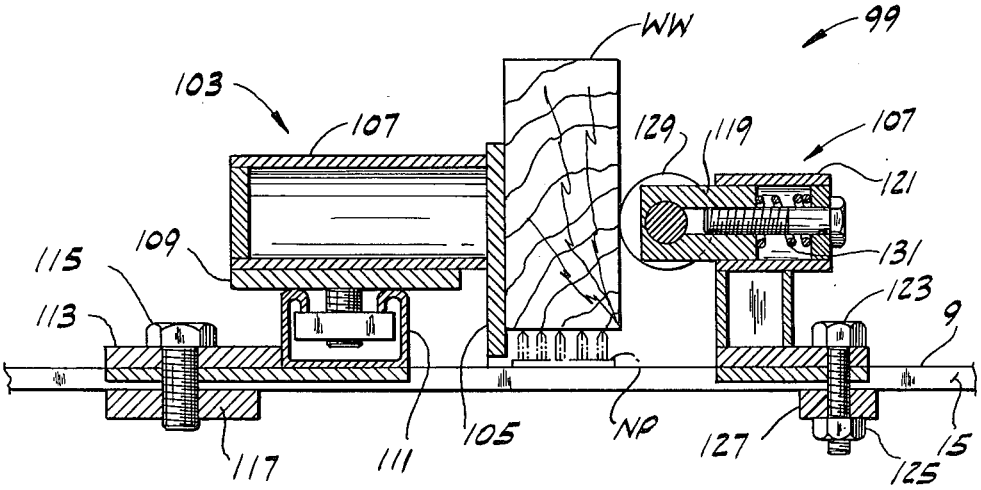
FIG. 10 is an enlarged vertical section on line 10—10 of FIG. 4.

Indicated generally at 99 and 101 on the table at opposite ends of the truss are clamps for clamping relatively short wood web members WW (as opposed to metal web members MW) in a position in which they extend transversely with respect to the table between the chord members CH1, CH2 at the ends of the truss to "finish" the ends of the truss. The clamp 99 at the left end of the truss (as viewed in FIGS. 1 and 4) comprises a first clamping member, generally designated 103, in the form of a clamping plate 105 extending transversely with respect to the table in a vertical plane for engagement with the outer vertical face of the wood web member WW, and a second clamping member, generally designated 107, engageable with the inner vertical face of the web member for clamping it against the clamping plate 105. As shown best in FIG. 10, the clamping plate 105 of the first clamping member 103 is mounted at one end of a horizontal cylindric member 107 rigidly secured to a pad 109 which is slidably adjustable along the open top of a channel 111 extending transversely with respect to the table top. The channel 111 is rigidly attached, as by welding, to a base plate 113 secured flat on the upper deck of the table between the outside jaw members 23 by a bolt 115 extending down through the central slot 15 in the upper deck and threaded into a nut 117 spanning the slot on the underside of the deck.

The second clamping member 107 of clamp 99 comprises a head 119 slidable longitudinally relative to the table in a tubular guide member 121 secured to the table by means of a bolt 123 extending down through the central slot 15 in the upper deck of the table into a nut 125 beneath a cross member 127 spanning the slot on the underside of the deck 9. The head 119 has a pair of rollers 129 mounted on opposite sides thereof for rotation on an axis extending generally transversely with respect to the table top. A coil compression spring 131 biases the head 119 and rollers 129 thereon toward the clamping plate 105 of the first clamping member 103 for clamping the wood web member WW thereagainst. The rollers 129 facilitate placement of the web member between the clamping members 103, 107 and removal of the web member from between the clamping members after the truss has been fabricated. The clamp 99 may be adjusted longitudinally of the table by loosening bolts 115 and 123, sliding the first and second clamping members 103, 107 to the desired longitudinal position, and retightening the bolts.

Figure 11:
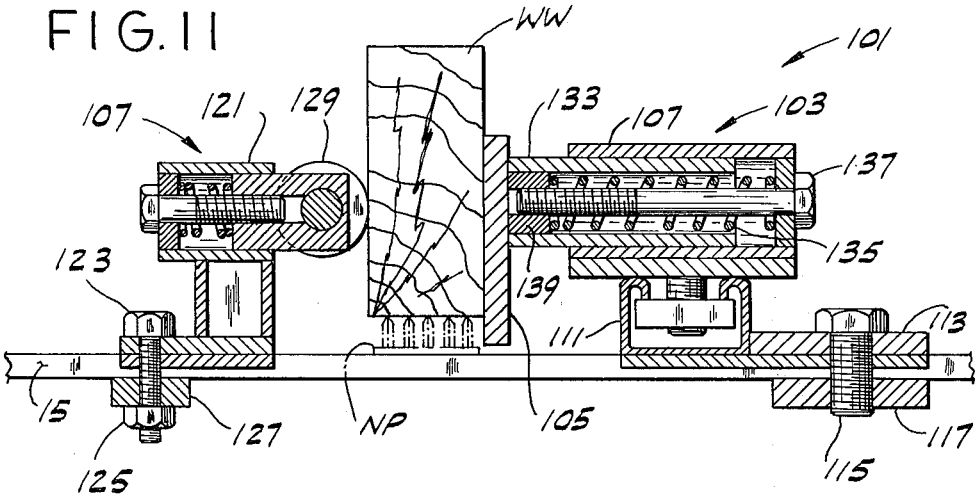
FIG. 11 is an enlarged vertical section on line 11—11 of FIG. 4.

The clamp 101 at the right end of the truss is identical to the clamp 99 described hereinabove except that the clamping plate 105 of the first clamping member 103, instead of being fixed with respect to the channel 111 and base plate 113, is adapted for limited movement in the longitudinal direction with respect to the table to accommodate any small differences in the lengths of the chord members CH1, CH2 from one truss to the next. If a truss of considerably different length is to be fabricated, the entire clamp 101 may be adjusted longitudinally of the table by loosening bolts 115 and 123 as described hereinabove. As illustrated in FIG. 11, the clamping plate 105 of the clamp 101 is mounted at the outer end of a tubular member 133 having a telescoping fit within a cylindric member corresponding to the cylindric member 107 of clamp 99 and therefore also designated 107. A spring 135 biases the tubular member 133 and clamping plate 105 toward the rollers 129 of the second clamping member 107 for clamping the wood web member WW thereagainst. A bolt 137 engageable with the closed end of the cylindric member 107 and threaded into a plug 139 in the tubular member 133 limits outward longitudinal movement of the clamping plate.

It will be noted that the clamping plates 105 of the clamps 99, 101 are sized to fit between the chord members of the shallowest truss capable of being fabricated by the machine. When a deeper truss is to be fabricated, requiring longer wood web members WW, a longer clamping plate (not shown) may be clipped onto the front of the shorter clamping plate.

Figure 13:
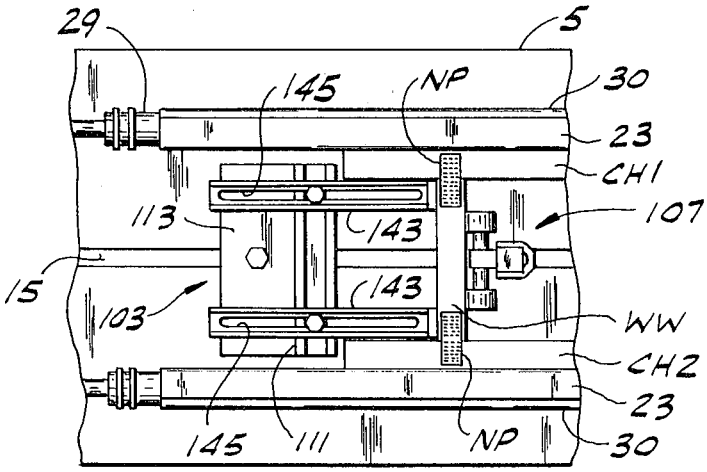
FIG. 13 is a plan showing another special clamping arrangement.
Figure 12:
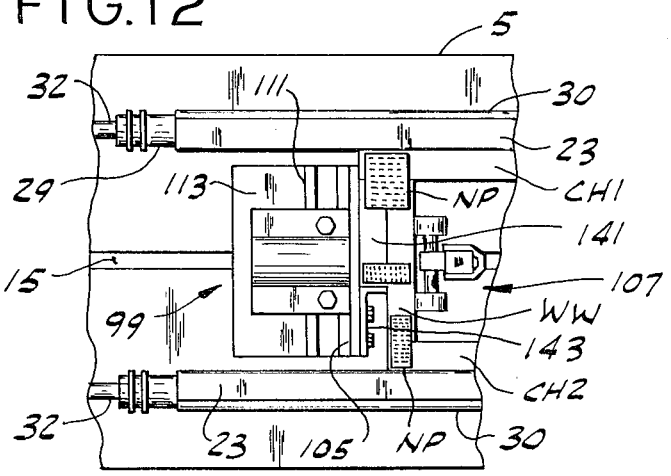
FIG. 12 is a plan showing a special clamping arrangement.

As indicated at 141 in FIG. 12, blocks are sometimes secured to the ends of a truss for supporting the truss on a foundation wall, for example. For this reason, provision is also made for bolting an angle 143 onto the front of each clamping plate 105, with one leg of the angle extending forwardly from the plate (longitudinally of the table) for engagement with a block 141 to hold it in a position in which it laps a chord member and the wood web member with one end of the block flush with an outside face of the chord member (see FIG. 12). The position of this angle in the transverse direction may be varied according to the length of the block 141 by slidably adjusting the pad 109 along the channel 111.

Where a wood web member WW is to be spaced inwardly from a respective end of the truss, as illustrated in FIG. 13, the clamping plate 105 of the first clamping member 103 of the respective clamp 99, 101 is replaced by two elongate clamping bars, each designated 143, which are secured (e.g., bolted) to the channel 111 to extend longitudinally of the table between the chord members for engagement with the wood web member. A slot 145 in each bar provides longitudinal adjustment of the clamping bars 143 relative to the channel 111 according to the distance the wood web member is spaced in from the end of the truss.

It will be understood that where two or more trusses are to be formed on the table at one time two sets of clamps 99, 101 will be required, one set for each truss.

Figure 14:
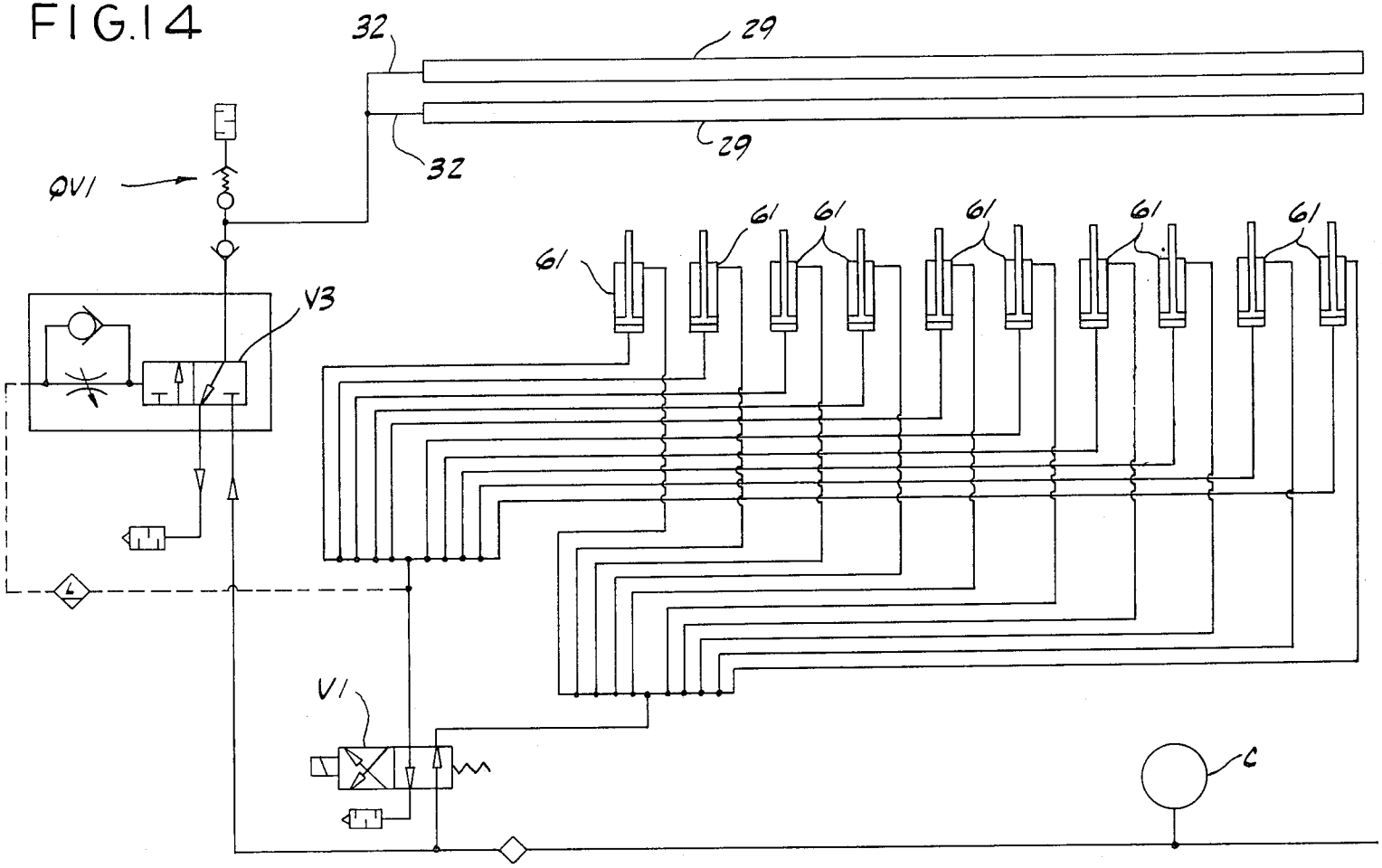
FIGS. 14 and 14A are pneumatic circuit diagrams.
Figure 14A:
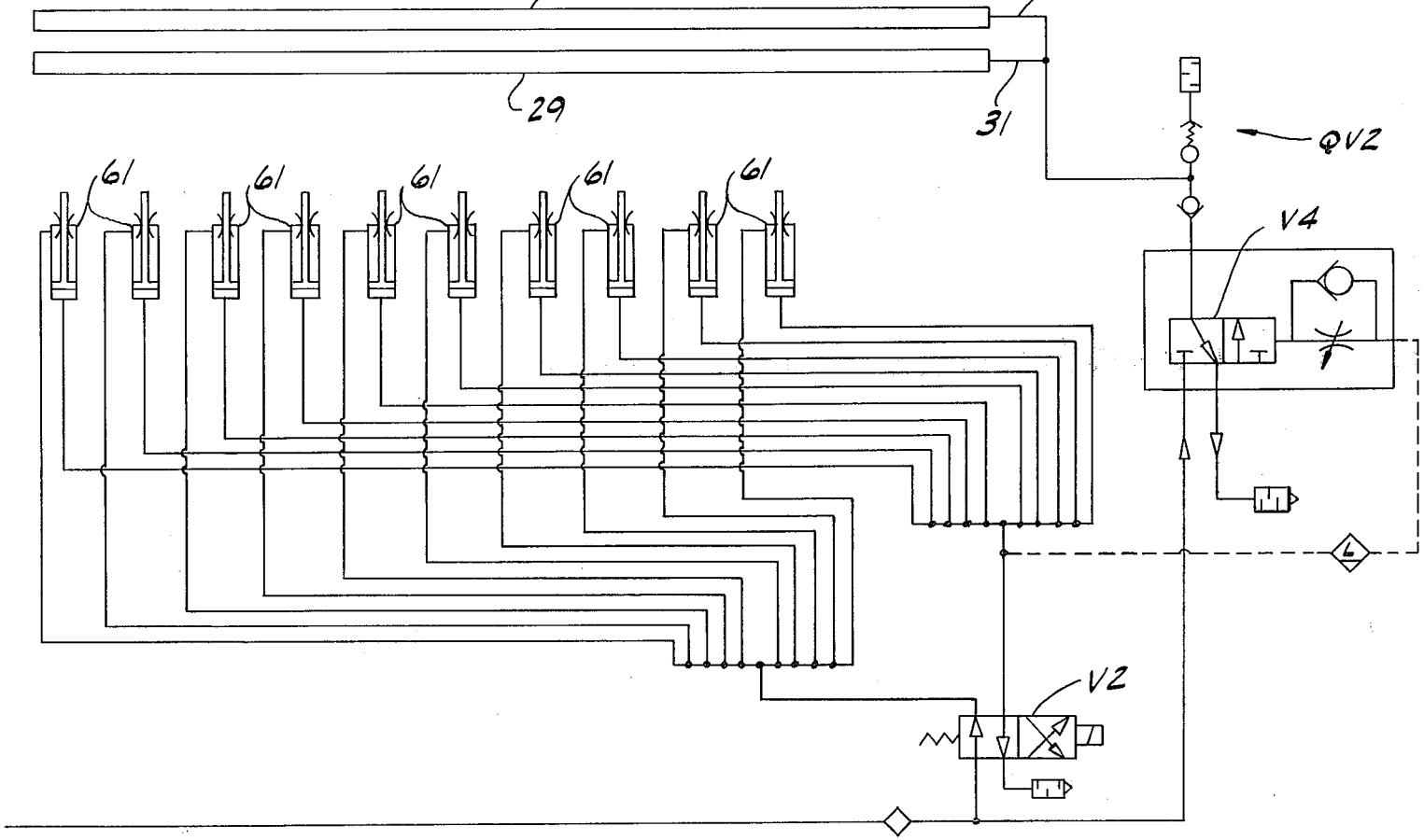

The pneumatic circuitry of the machine 1 is illustrated schematically in FIGS. 14 and 14A, the circuit for the left half of the machine being separate from and a mirror image of the circuit for the right half of the machine. The supply of pressure air from an air compressor C to the double-acting pneumatic cylinder units 61 operating the camming bars 57 of the inside jaw assemblies 25 is controlled by a pair of solenoid-operated directional valves V1, V2, each of which is movable between a first position in which pressure air is supplied to the lower chambers of the cylinder units on a respective side of the table for extending the pistons and thereby moving the camming bars 57 up to spread the inside jaws 27*a, b* to their extended position, and a second position in which pressure air is supplied to the upper chambers of the cylinders for retracting the pistons and thereby moving the camming bars down to permit the inside jaws to return to their retracted position under the bias of springs 51. Valves V1, V2 normally occupy this latter (second) position. The supply of pressure air to the pneumatic hoses 29 is controlled by a second pair of directional valves V3, V4, each being movable between a first position in which the pressure air is supplied to the two hoses 29 on a respective side of the table for inflating them, and a second position in which the hoses are vented through quick-exhaust valves QV1, QV2. Valves V3, V4 normally occupy this latter (second) position. Valves V3, V4 are operable to move to their stated first positions only after (e.g., within one second after) valves V1 and V2 have moved to their stated first positions, thus ensuring that the inside jaws 27*a, b* move to their extended positions prior to inflation of the hoses 29 to effect inward movement of the outside jaws 23 to clamp the chord members CH1, CH2 against the inside jaws.

Operation of the truss-fabricating machine is as follows:

Prior to placing the metal web and chord members on the table, the inside and outside jaws 27, 23 are adjusted according to the depth of the truss (or trusses) to be fabricated. The inside jaws are adjusted by attaching the appropriate length jaw head portions 43 to the jaw body portions 41. The outside jaws are adjusted by placing the spacer blocks 77 in the appropriate orientation to space the backing members 30, and thus the outside jaws 23, the appropriate distance apart. The spacing between the locator pins 87 is also set according to the size and spacing of the metal web members MW. This is accomplished simply by sliding the locator pin assemblies 83 in the central slot 15 in the top of the table to the proper positions. Finally, the clamps 99, 101 for clamping the wood web members WW between the chord members are appropriately positioned longitudinally of the table according to the length of the truss (or trusses) to be fabricated and according to the positions of the wood web members with respect to the chord members.

Figure 15:
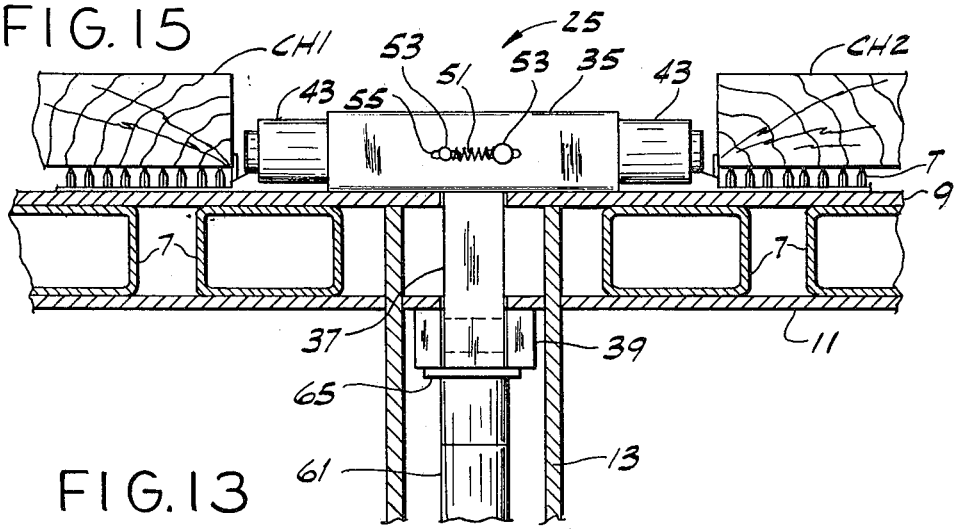
FIG. 15 is a view similar to FIG. 5 with the machine modified for clamping the chord members in a horizontal rather than a vertical position on the machine.

If a truss is to be fabricated with the chord members CH1, CH2 upright, that is, with their relatively narrow (e.g., 2 in.) faces horizontal and their relatively wide (e.g., 4 in.) faces vertical, the U-shaped support members 39 are positioned as shown in FIG. 6 for supporting the guides 35 at an elevation wherein the inside jaws 27*a,b,* when extended, engage the chord members at the proper points. If, on the other hand, the trusses are to be fabricated with the chord members lying flat, that is, with their wide faces horizontal and their narrow faces vertical, then the support members should be removed from beneath the guides 35 and the guides allowed to lie directly on the top of the table, as shown in FIG. 15. This ensures that the inside jaws 27*a, b,* when extended, engage the narrow vertical faces of the chord members at the proper elevation. With the guides 35 resting directly on the table, as shown in FIG. 15, the support members 39 may be placed between the washers 65 at the upper ends of the pneumatic cylinders 61 and the underside of the lower deck 11 of the table top to prevent upward movement of the jaw assemblies 25 relative to the table.

With the machine properly adjusted according to the size, configuration and number of trusses to be fabricated, the lower set (or sets) of metal web members MW (one set per truss) are placed atop the table with the teeth of the web members pointing upwardly and with the locator pins 87 projecting up through the openings 87 in the legs of the web members to properly locate the web members on the table. When the metal web members are so located, their toothed connector portions lie slightly outwardly of the vertical planes defined by the outer ends of the inside jaws 27*a, b* and inwardly of the webs 67 of the outside jaws 23. Rectangular nailing plates NP are also placed on the top of the table with their teeth pointing upwardly at positions corresponding to the intersections of the wood web members WW and the chord members. The chord members are then placed between the inside and outside jaws 27, 23 with the lower faces of the chord members in contact with the teeth of the metal web members MW and the nailing plates NP. The wood web members WW are subsequently placed in the clamps 99, 101.

After the lower set(s) of metal web members MW, the wood web members WW, and the chord members CH1, CH2 have been positioned on the table, the solenoids of valves V1 and V2 are actuated for the delivery of pressure air to the lower chambers of the pneumatic cylinders 61 for raising the camming bars 57 to spread the inside jaws 27*a, b* apart to their extended positions. Immediately thereafter (within one second, for example) valves V3 and V4 are operable for delivery of pressure air to the four hoses 29 to inflate them and thereby move the outside jaws 23 inwardly a relatively short distance to effect a clamping action on the chord members by clamping them against the inside jaws 27*a, b* and against the ends of the wood web members WW. When the chord members of the trusses being fabricated are securely clamped in fixed cambered position with their lower faces in contact with the teeth of the metal web members and nailing plates NP, the upper set(s) of metal web members is manually placed atop the chord members directly above the lower web members with the teeth of the connector portions of the web members pointed down and substantially centered on the upper faces of the chord members. Nailing plates NP (FIG. 4) are also placed atop the chord members and wood web members WW at the intersections thereof.

When the upper metal web members MW and nailing plates NP are in place, the press 19 is intermittently advanced along the table to press the teeth of the nailing plates and the metal web members into the upper and lower faces of the wood chord and web members. After this process has been completed, the solenoids of valves V1 and V2 are actuated for the delivery of pressure air to the upper chambers of the pneumatic cylinder units 61 for moving the camming bars 57 downwardly, resulting in the movement of the inside jaws 27*a, b* to their retracted positions under the bias of springs 51. Immediately thereafter (e.g., within one second thereafter) valves V3 and V4 are operable for venting the hoses 29 through the quick-exhaust valves QV1 and QV2 to deflate them. The finished truss (or trusses) are then removed from the table. The outside jaws 23 may be moved slightly outwardly by hand away from the chord members CH1, CH2 to facilitate removal of the truss(es) from the table. The process is then repeated to fabricate additional trusses.

The fact that the clamping apparatus on the left and right sides of the table are controlled by separate pneumatic circuitry and thus are operable independently of one another is advantageous where two trusses are to be fabricated on the table. Thus, after one truss has been pressed and completed, and while the press is in the process of pressing the second truss, the completed truss may be removed from the table (by venting the appropriate pair of hoses 29) and additional web and chord members set in place for the next truss to be fabricated. When making two or more trusses on the machine at one time, it is preferable, when possible, to leave a spacing of several feet between the trusses on the table. This provides a space in which the press may temporarily dwell after the completion of one truss in the event the web and chord members of the next truss are not yet ready to be pressed. The completed truss may be removed from the table while the press is at this location. It is contemplated that two presses 19 may be used, each traversing one-half of the table, to reduce the pressing time.

While the truss-fabricating machine of this invention is especially suited for the fabrication of parallel-chord flat trusses of the type utilizing V-shaped metal web members, it will be understood that the machine can also be used to fabricate trusses wherein the web members are wood web members constituted by lengths of lumber (e.g., 2"×4" lumber) extending in zig-zag configuration or a combination vertical-zig-zag configuration between the chord members. Reference may be made to U.S. Pat. Nos. 3,978,783 and 4,024,809 showing the general configuration of parallel-chord trusses using wood web members. Where wood web members are used, the inside jaw assemblies 25 are removed, the chord members CH1, CH2 being clamped by the outside jaw members 23 directly against the wood web members. The locator pin assemblies 83 and clamp members 107 of clamps 99 and 101 are also removed. Prior to placement of the wood web and chord members on the table, conventional nailing plates are placed atop the table with their teeth pointing up at locations corresponding to the intersections of the web and chord members. The web and chord members are then placed in position on these nailing plates and the web and chord members clamped in fixed position relative to one another by the outside jaws 23. Where all the wood web members WW between the two vertical end web members are angled in zig-zag configuration with respect to the chord members, the outside clamp members 103 of clamps 99 and 101 may have to be modified to render them capable of pushing the end web members toward one another longitudinally of the table to squeeze all the web members together and hold them in proper position with respect to the chord members. In instances where there are adjacent interior vertical web members (defining a duct opening in the truss, for example) and angled web members between them and the vertical end web members, means may be provided for pushing the interior web members away from one another longitudinally of the table (i.e., toward clamp members 103) to squeeze the web members together and hold them in proper position. A second set of nailing plates is then placed on the upper faces of the web and chord members at the intersections thereof and the press 19 advanced intermittently along the table to press the nailing plates into the web and chord members.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A machine for fabricating trusses of the type comprising a pair of generally parallel wood chord members having opposing inside faces spaced apart a fixed predetermined distance, and outside faces, a series of web members spanning the wood chord members, and connector means having teeth adapted to be pressed into the wood chord members for rigidly interconnecting the web and chord members, said machine comprising:

a table having an elongate top for supporting said pair of chord members, said web members and said connector means in a position in which the web members are generally horizontal, in which the teeth of said connector means are generally vertical, and in which the wood chord members extend longitudinally of the table;

means on the top of the table for clamping the chord members in fixed position with respect to the table comprising outside jaw means engageable with the outside faces of the chord members of said pair of chord members, said outside jaw means comprising expansible tube means extending longitudinally of the table for effecting clamping action of the outside jaw means on said chord members to clamp them in fixed position with respect to the table, said tube means having inlet means for entry of a pressurized fluid into the tube means thereby to expand the tube means in cross section, said tube means during such expansion being adapted to effect said clamping action; and a press movable longitudinally with respect to the table top for pressing the teeth of said connector means into the chord members when the chord members are clamped in fixed position with respect to the table.

2. A machine as set forth in claim 1 wherein said outside jaw means further comprises a first outside jaw engageable with the outside face of the first chord member of said pair of chord members and a second outside jaw engageable with the outside face of the second chord member, said tube means comprising tubing extending longitudinally of the table adapted to be expanded to effect movement of the outside jaws relative to one another transversely of the table to clamp the chord members in fixed position with respect to the table.

3. A machine as set forth in claim 2 wherein said expansible tubing comprises a first expansible tube extending longitudinally of the table closely adjacent the first outside jaw on the outside of the jaw, and a second expansible tube extending longitudinally of the table closely adjacent the second outside jaw on the outside of the jaw, said inlet means comprising an inlet in each of said first and second tubes through which said pressurized fluid may be introduced into the tubes thereby to expand the tubes in cross section, said tubes during such expansion being engageable with the outside jaws for moving them inwardly to clamp the chord members.

4. A machine as set forth in claim 3 further comprising a pair of inside jaws between the outside jaws including a first inside jaw engageable with the inside face of the first chord member and a second inside jaw engageable with the inside face of the second chord member, said outside jaws being adapted to clamp the chord members against the inside jaws.

5. A machine as set forth in claim 4 wherein said inside jaws are relatively movable transversely of the table between an extended position in which the jaws are spaced apart a distance corresponding to said predetermined distance, and a retracted position in which the jaws are closer together, said machine further comprising means for expanding the inside jaws from said retracted to said extended position, said outside jaws being adapted to clamp the chord members against the inside jaws when the latter are in said extended position.

6. A machine as set forth in claim 5 wherein said expanding means comprises cam means.

7. A machine as set forth in claim 6 wherein said inside jaws are relatively closely adjacent one another when in said retracted position, said cam means comprising a vertical camming bar movable along its axis from a lowered position in which the upper end of the bar is below the inside jaws to a raised position in which the upper end of the bar moves between the jaws to spread them apart to said extended position.

8. A machine as set forth in claim 7 wherein said cam means further comprises power means for moving said camming bar between its raised and lowered positions.

9. A machine as set forth in claim 8 wherein said power means is operable to raise said camming bar and thereby spread the inside jaws to said extended position prior to delivery of pressurized fluid to said tubes for effecting movement of said outside jaws inwardly.

10. A machine as set forth in claim 4 wherein said pair of inside jaws is adjustable as a unit longitudinally of the table.

11. A machine as set forth in claim 4 wherein at least one inside jaw of said pair is adjustable for varying said predetermined distance to fabricate trusses of different depths.

12. A machine as set forth in claim 11 wherein said inside jaws are movable in a guide between said extended and retracted positions, at least one inside jaw having a body portion slidable in the guide and a head portion extending outwardly from one end of the body for engagement with the inside face of a respective chord member, said head portion being detachably mounted on the body portion for enabling a head portion of different size to be substituted therefor thereby to vary said predetermined distance.

13. A machine as set forth in claim 11 further comprising backing means on the outside of each tube engageable by the tube when the tube is expanded, and means for holding said backing means in fixed position with respect to the table against outward movement of the backing means away from a respective tube in reaction to expansion of the tube.

14. A machine as set forth in claim 13 wherein at least one holding means is adjustable for holding a respective backing means at different positions of transverse adjustment with respect to the table for varying the spacing between said tubes, and thus said outside jaws, according to said predetermined distance.

15. A machine as set forth in claim 14 wherein said holding means comprises a stop member mounted in fixed position with respect to the table top and a spacer for spacing said backing means inwardly from the stop member, the spacer having a plurality of different dimensions and being adapted to be placed between the stop member and the backing means in a plurality of different orientations to space the backing means inwardly from the stop member in said different positions of transverse adjustment.

16. A machine as set forth in claim 3 further comprising backing means on the outside of said tubing engageable by the tubing when the tubing is expanded, and means for holding said backing means in fixed position with respect to the table against outward movement of the backing means away from said tubing in reaction to expansion of said tubing.

17. A machine as set forth in claim 16 wherein said holding means is adjustable for holding said backing means at different positions of transverse adjustment with respect to the table for varying the spacing between said outside jaws in accordance with said predetermined distance.

18. A machine as set forth in claim 17 wherein said holding means comprises a stop member mounted in fixed position with respect to the table top and a spacer for spacing said backing means inwardly from the stop member, the spacing having a plurality of dimensions and being adapted to be placed between the stop member and the backing means in a plurality of different orientations to space said backing means inwardly from the stop member in said different positions of transverse adjustment.

19. A machine as set forth in claim 3 wherein said outside jaws comprise a pair of elongate members extending longitudinally of the table for engagement with the outside faces of the chord members along substantially the entire lengths of the chord members, said machine further comprising a plurality of pairs of inside jaws spaced at intervals longitudinally of the table between the outside jaws, each pair including a first inside jaw engageable with the inside face of the first chord member and a second inside jaw engageable with the inside face of the second chord member, said outside jaws being adapted to clamp the chord members against the inside jaws.

20. A machine as set forth in claim 19 wherein said pairs of inside jaws are mounted with said first inside jaws in position for imparting a camber to the first chord member and with said second inside jaws in position for imparting a camber to the second chord member when the chord members are clamped by the outside jaws against the inside jaws.

21. A machine as set forth in claim 20 wherein each outside jaw comprises a plurality of longitudinal sections thereby enabling the outside jaw readily to conform to said camber.

22. A machine as set forth in claim 21 wherein each outside jaw further comprises means for connecting said longitudinal sections in groups of predetermined number, said connecting means being adapted to permit adjacent sections of each group to resiliently flex relative to one another.

23. A machine as set forth in claim 22 wherein each section is of channel shape, having a vertical web engageable with the outside face of a respective chord member and parallel flanges extending generally horizontally outwardly from the web, said connecting means comprising metal strap means interconnecting the webs of adjacent sections in each group of sections.

24. A table as set forth in claim 2 further comprising means for venting said tube means to collapse it thereby to release said clamping action.

25. A machine as set forth in claim 1 especially adapted for fabricating trusses of the type wherein said web members are relatively flat metal web members and said connector means comprises connector plates formed integrally with the web members having teeth struck therefrom, said machine further comprising means for mounting metal web members in fixed position on the table top between said outside jaws with the teeth of the web members in position for being driven into the chord members when the latter are clamped in position.

26. A machine as set forth in claim 25 wherein said mounting means comprises a series of locator pin assemblies, each comprising a pin projecting above the table top receivable in an opening in a web member.

27. A machine as set forth in claim 26 wherein each pin assembly is adjustable longitudinally with respect to the table for adjusting the spacing between the pins.

28. A machine as set forth in claim 27 wherein each pin assembly comprises latch means movable between a latching position for latching the assembly on the table and a release position for removal of the assembly from the table.

29. A machine as set forth in claim 1 further comprising a clamp for clamping a wood web member in a position in which it extends generally transversely with respect to the table between the chord members, said clamp comprising first and second clamping members engageable with opposite side faces of the wood web member for clamping it in fixed position with respect to the table.

30. A machine as set forth in claim 29 wherein said clamp further comprises means for guiding the second clamping member for movement longitudinally of the table relative to the first clamping member, the second clamping member being biased toward the first clamping member for clamping the wood web member thereagainst.

31. A machine as set forth in claim 30 wherein said means for guiding said second clamping member comprises a tubular guide member secured to the table, said second clamping member comprising a head slidable in the guide member, said head having a pair of rollers mounted thereon for rotation on an axis extending generally transversely with respect to the table top, said rollers being engageable with said wood web member for clamping it against the first clamping member.

32. A machine as set forth in claim 31 wherein said clamp is adjustable longitudinally with respect to the table top according to the desired longitudinal position of the wood web member relative to the chord members.

33. A machine for fabricating trusses of the type comprising a pair of generally parallel wood chord members having opposing inside faces spaced apart a fixed predetermined distance, and outside faces, a series of web members spanning the wood chord members, and connector means having teeth adapted to be pressed into the wood chord members for rigidly interconnecting the web and chord members, said machine comprising:

a table having an elongate top for supporting said pair of chord members, said web members and said connector means in a position in which the web members are generally horizontal, in which the teeth of said connector means are generally vertical, and in which the wood chord members extend longitudinally of the table;

means on the top of the table for clamping the chord members in fixed position with respect to the table comprising:

(a) a first outside jaw engageable with the outside face of the first chord member of said pair of chord members;

(b) a second outside jaw engageable with the outside face of the second chord member of said pair; and (c) a plurality of pairs of inside jaws mounted in fixed position with respect to the table at spaced intervals longitudinally of the table between the outside jaws, each pair of inside jaws including a first inside jaw engageable with the inside face of said first chord member and a second inside jaw engageable with the inside face of the second chord member, said pairs of inside jaws being mounted with the first inside jaws in position for imparting a camber to the first chord member and with the second inside jaws in position for imparting a camber to the second chord member, said outside jaws being relatively movable transversely of the table to clamp the chord members against the inside jaws thereby to hold them in fixed cambered position with respect to the table; and a press movable longitudinally with respect to the table top for pressing the teeth of the connector means into the chord members when the chord members are clamped in said fixed cambered position.

34. A machine as set forth in claim 33 wherein each of said outside jaws comprises an elongate member extending longitudinally of the table for engagement with the outside face of a respective chord member along substantially the entire length of the chord member.

35. A machine as set forth in claim 34 wherein each outside jaw comprises a plurality of longitudinal sections thereby enabling it readily to conform to said camber when clamping a respective chord member against the inside jaws.

36. A machine as set forth in claim 35 wherein each outside jaw further comprises means for connecting said longitudinal sections in groups of predetermined number, said connecting means being adapted to permit adjacent sections of each group to resiliently flex relative to one another.

37. A machine as set forth in claim 36 wherein each section is of channel shape, having a vertical web engageable with the outside face of a respective chord member and parallel flanges extending generally horizontally outwardly from the web, said connecting means comprising metal strap means interconnecting the webs of adjacent sections in each group of sections.

38. A machine as set forth in claim 33 wherein said table top has a slot therein extending longitudinally of the table between said outside jaws, said slot being cambered according to the camber to be imparted to said chord members, and means extending up through the slot for mounting each pair of inside jaws in fixed position with respect to the table.

39. A machine as set forth in claim 33 wherein the two inside jaws of each pair of inside jaws are relatively movable transversely of the table between an extended position in which the jaws are spaced apart a distance corresponding to said predetermined distance, and a retracted position in which the jaws are closer together, said machine further comprising means for expanding the inside jaws from said retracted to said extended position, said outside jaws being adapted to clamp the chord members against the inside jaws when the latter are in said extended position.

40. A machine as set forth in claim 39 wherein said expanding means comprises cam means.

41. A machine as set forth in claim 40 wherein said inside jaws are relatively closely adjacent one another when in said retracted position, said cam means comprising a vertical camming bar movable along its axis from a lowered position in which the upper end of the bar is below the inside jaws to a raised position in which the upper end of the bar moves between the jaws to spread them apart to said extended position.

42. A machine as set forth in claim 41 wherein said cam means further comprises power means for moving said camming bar between its raised and lowered positions.

43. A machine as set forth in claim 33 wherein each pair of inside jaws is adjustable as a unit longitudinally of the table.

44. A machine as set forth in claim 33 wherein at least one inside jaw of each pair of inside jaws is adjustable for varying said predetermined distance to fabricate trusses of different depths.

45. A machine as set forth in claim 44 wherein the inside jaws of each pair are movable in a guide between said extended and retracted positions, at least one inside jaw having a body portion slidable in the guide and a head portion extending outwardly from one end of the body portion for engagement with the inside face of a respective chord member, said head portion being detachably mounted on the body portion for enabling a head portion of different size to be substituted therefor thereby to vary said predetermined distance.

46. A machine as set forth in claim 44 further comprising means for mounting each outside jaw at different positions of transverse adjustment with respect to the table for varying the spacing between the outside jaws according to said predetermined distance.

47. A machine as set forth in claim 46 wherein said mounting means comprises a stop member mounted in fixed position with respect to the table top and a spacer for spacing a respective outside jaw inwardly from the stop member, the spacer having a plurality of different dimensions and being adapted to be placed between the stop member and the outside jaw in a plurality of different orientations to space the outside jaw inwardly from the stop member in said different positions of transverse adjustment.

* * * * *